US006422412B1

(12) United States Patent
Sagawa

(10) Patent No.: US 6,422,412 B1
(45) Date of Patent: Jul. 23, 2002

(54) CONTAINER WITH CAP

(75) Inventor: Daisuke Sagawa, Gotemba (JP)

(73) Assignee: Tetra Laval Holdings & Finance, S.A. (CH)

( * ) Notice: Subject to any disclaimer, the term of this patent is extended or adjusted under 35 U.S.C. 154(b) by 0 days.

(21) Appl. No.: 09/700,410

(22) PCT Filed: Jun. 9, 1999

(86) PCT No.: PCT/JP99/03067

§ 371 (c)(1),
(2), (4) Date: Nov. 15, 2000

(87) PCT Pub. No.: WO99/64315

PCT Pub. Date: Dec. 16, 1999

(30) Foreign Application Priority Data

Jun. 11, 1998 (JP) ..... 10-163652

(51) Int. Cl.[7] ..... B67D 5/06

(52) U.S. Cl. ..... 220/277; 222/81; 222/83

(58) Field of Search ..... 220/255, 256, 220/257, 277, 278; 222/81, 83, 83.5, 87–89, 91, 541.2, 541.5, 541.8

(56) References Cited

U.S. PATENT DOCUMENTS 5,027,979 A * 7/1991 Kawajiri et al. ..... 222/83
5,141,133 A * 8/1992 Ninomiya et al. ..... 222/83
5,255,813 A * 10/1993 Berggren et al. ..... 220/278
5,303,837 A * 4/1994 Adams et al.

FOREIGN PATENT DOCUMENTS

JP 8-133324 * 5/1996
JP 10-000087 * 4/1998

* cited by examiner

*Primary Examiner*—Nathan J. Newhouse
(74) *Attorney, Agent, or Firm*—Lorusso & Loud

(57) ABSTRACT

An object of the present invention is to provide a container (21) having a cap capable of simplifying an unsealing operation, improving resealability against leakage of the contents thereof, and reducing cost. The container (21) includes a container body (22) having a rupture portion for forming a discharge opening, and a cap (23) attached to the container body (22) in correspondence to the rupture portion. The cap (23) includes an annular base member (25) fixedly attached to the container body (22); a screw cap (27); and a retainer (26) including an unsealing member formed at a tip for rupturing the rupture portion, a first screw-engagement portion defined in cooperation with the base member (25), and a second screw-engagement portion defined in cooperation with the screw cap (27). The first and second screw-engagement portions have screw-engagement directions opposite to each other. The screw cap (27) and the retainer (26) include a rotation control portion, which inhibits relative rotation therebetween when a force not greater than an allowable value is applied thereto and which permits relative rotation therebetween when a force greater than the allowable value is applied thereto. After the rupture portion is ruptured, the retainer (26) is moved axially by a predetermined amount and is then stopped by a stop mechanism.

8 Claims, 7 Drawing Sheets

CONTAINER WITH CAP

TECHNICAL FIELD

The present invention relates to a container having a cap.

BACKGROUND ART

Conventionally, a container having a cap, which includes a container body and a cap, has been provided (refer to Japanese Patent Application Laid-Open (kokai) No. 7-277324).

FIG. 1 is a sectional view of a main portion of the conventional container having a cap.

As shown in FIG. 1, a cap composed of a cover-receiving flange portion 5 and a cover plate 3 is attached to a top panel of a container body 1. The cover plate 3 is supported pivotally with respect to the cover-receiving flange portion 5 while a hinge portion 2 serves as a fulcrum, so that the cover plate 3 can be opened and closed in the direction indicated by the arrow of FIG. 1. When the cover plate 3 is first opened, a user holds an end portion of a seal 4 and pulls it off. The container is thus unsealed while the cover plate 3 is opened. Thus, the user can pour out the contents; i.e., liquid food, from a discharge opening 1A.

The cover-receiving flange portion 5 is disposed on the top panel of the container body 1 along the upper circumferential edge of the discharge opening 1A. The cover-receiving flange portion 5 engages with a hook portion 3A formed along the circumferential edge of the cover plate 3 against their mutual repellent force, thereby establishing a state in which the cover plate 3 is reclosed.

Next, another conventional container having a cap will be described (refer to Japanese Kohyo (PCT) Patent Publication No. 9-501890).

FIG. 2 is a sectional view of a main portion of the other conventional container having a cap.

As shown in FIG. 2, a cap composed of a base flange 15, a movable cylinder 16, and a screw cap 17 is attached to the top panel of a container body 11. Before the container is unsealed, a discharge opening 11A formed in the top panel of the container body 11 is sealed by means of a seal 12. The base flange 15 whose lower portion is formed into a flange portion 13 and whose upper portion is formed into a cylindrical portion 14 integrated with the flange portion 13 is fixedly attached to an upper circumferential edge of the discharge opening 11A.

A female screw 14A is formed on the inner surface of the cylindrical portion 14, and a male screw 14B is formed on the outer surface of the cylindrical portion 14. The movable cylinder 16 is fitted into the cylindrical portion 14 while being screw-engaged with the female screw 14A. A pointed tip portion 16A for rupturing the seal 12 is formed at the lower end of the movable cylinder 16. A plurality of ribs 16B extend vertically on the inner surface of the movable cylinder 16.

The male screw 14B is engaged with a female screw 17B formed on the inner surface of the screw cap 17. A plurality of arms 17A are projected within the screw cap 17, extending downward from the top panel of the screw cap 17. When the screw cap 17 is rotated in a tightening direction, the arms 17A engage with the ribs 16B. Thus, as the screw cap 17 is rotated, the movable cylinder 16 is rotated to be moved downward along the cylindrical portion 14 to a predetermined position.

Before the container is unsealed, the pointed tip portion 16A is located above the seal 12. When the screw cap 17 is rotated in the tightening direction in order to unseal the container, the pointed tip portion 16A ruptures the seal 12. Subsequently, the screw cap 17 is rotated in an opening direction to thereby be removed from the cylindrical portion 14.

When the screw cap 17 is rotated in the opening direction, the arms 17A do not engage with the ribs 16B, but slide on the ribs 16B. For that purpose, a slope portion is formed on at least one of the end faces of the ribs 16B and arms 17A.

The above-described containers having a cap involve the following problems. In the case of the container shown in FIG. 1, after the cover plate 3 is opened, the seal 4 must be pulled off in order to unseal the container; i.e., troublesome work is involved. Also, when the cover plate 3 is closed in such a manner that engagement between the cover-receiving flange portion 5 and the hook portion 3A is incomplete, resealability is impaired, causing leakage of liquid food from inside the container.

In the case of the container having a cap shown in FIG. 2, the seal 12 can be ruptured by rotating the screw cap 17 in the tightening direction, and the screw cap 17 can be removed from the cylindrical portion 14 through rotation in the opening direction. That is, the screw cap 17 can be opened or closed by means of a simple operation. However, a plurality of ribs 16B must be formed on the inner surface of the movable cylinder 16, and a plurality of arms 17A must be projected within the screw cap 17 in such a manner as to extend downward from the top panel of the screw cap 17. Not only does the structure of the movable cylinder 16 and the screw cap 17 become complicated, but also the cost of the container increases.

Particularly, in order to prevent the arms 17A from sliding idly on the ribs 16B when the screw cap 17 is tightened, the arms 17A must be rendered rigid, thereby requiring the designer to consider, for example, the material, structure, and strength of the arms 17A. Thus, the cost of the container is further increased.

An object of the present invention is to solve the above-mentioned problems involved in the conventional containers having a cap, and to provide a container having a cap capable of simplifying an unsealing operation, improving resealability against leakage of the contents thereof, and reducing cost.

DISCLOSURE OF THE INVENTION

To achieve the above object, the present invention provides a container having a cap comprising a container body having a rupture portion for forming a discharge opening, and a cap attached to the container body in correspondence to the rupture portion.

The cap comprises an annular base member fixedly attached to the container body; a screw cap; and a retainer comprising an unsealing member formed at a tip for rupturing the rupture portion, a first screw-engagement portion defined in cooperation with the base member, and a second screw-engagement portion defined in cooperation with the screw cap.

The first and second screw-engagement portions have screw-engagement directions opposite to each other.

The screw cap and the retainer include a rotation control portion, which inhibits relative rotation therebetween when a force not greater than an allowable value is applied thereto and which permits relative rotation therebetween when a force greater than the allowable value is applied thereto.

After the rupture portion is ruptured, the retainer is moved axially by a predetermined amount and is then stopped by stop means.

When the screw cap is rotated for removal, the retainer is advanced, since relative rotation between the screw cap and the retainer is inhibited. As a result, the unsealing member ruptures the rupture portion, thereby forming a discharge opening.

Upon axial advancement of a predetermined amount, the retainer is stopped by the stop means. Subsequently, when the screw cap is rotated further, relative rotation between the screw cap and the retainer is permitted, so that the screw cap can be removed.

As described above, simply by rotating the screw cap counterclockwise, the rupture portion is ruptured to thereby unseal the container, whereby an unsealing operation can be simplified. Also, simply by rotating the screw cap clockwise, the cap can be closed, whereby resealability can be improved to thereby prevent leakage of the contents of the container. Since the structure of the retainer and screw cap can be simplified, the cost of the container can be reduced.

Once the container is unsealed while the screw cap is removed therefrom, screw engagement at the first screw-engagement portion becomes deep. Therefore, even when the screw cap is tightened, the container cannot be restored to the initial state thereof. Accordingly, a user can easily recognize that the container has already been unsealed.

The present invention provides another container having a cap, wherein the first screw-engagement portion comprises a lower retainer male screw formed on the outer surface of a lower portion of the retainer, and a base female screw formed on the inner surface of the base member.

The present invention provides still another container having a cap, wherein the second screw-engagement portion comprises an upper retainer male screw formed on the outer surface of an upper portion of the retainer, and a screw cap female screw formed on the inner surface of the screw cap.

In this case, since the retainer is covered with the screw cap, the second screw-engagement portion can assume a large contact area.

Accordingly, the screw cap can transmit a large torque to the retainer, so that the rotation control portion does not permit easy relative rotation.

The present invention provides a further container having a cap, wherein the second screw-engagement portion comprises a screw cap male screw formed on the outer surface of the screw cap and an upper retainer female screw formed on the inner surface of an upper portion of the retainer.

The present invention provides a still further container having a cap, wherein the screw cap is advanced while being rotated in a removing direction.

The present invention provides a still further container having a cap, wherein, while the rotation control portion inhibits relative rotation, rotation of the screw cap causes rotation and advancement of the retainer, causing the unsealing member to rupture the rupture portion.

The present invention provides a still further container having a cap, wherein the rotation control portion assumes the form of a welded portion formed by welding the screw cap and the retainer.

The present invention provides a still further container having a cap, wherein the stop means comprises a stepped portion formed on the retainer and an upper surface of the base member.

In this case, there is no need for providing a specific stopper for stopping the retainer. Accordingly, not only can the structure of the container be simplified, but also the cost of the container can be reduced.

BEST MODE FOR CARRYING OUT THE INVENTION

The embodiments of the present invention will next be described in detail with reference to the drawings.

Figure 1:
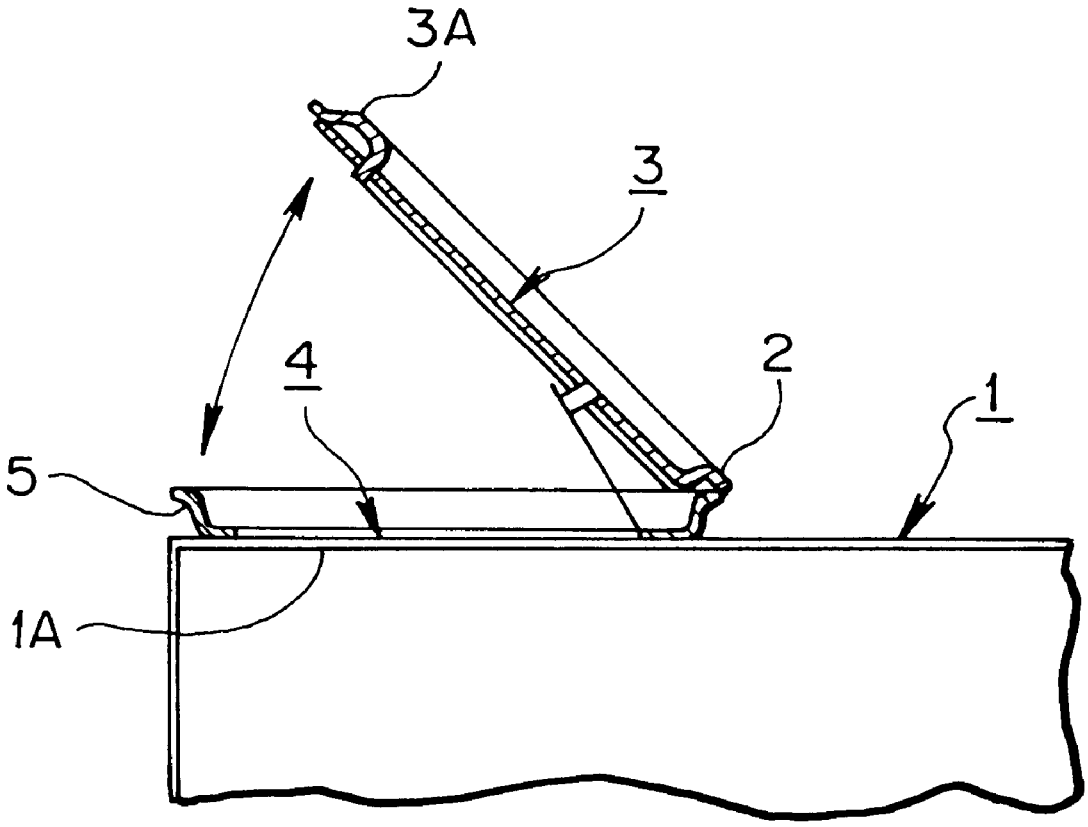
FIG. 1 PRIOR ART
FIG. 1 is a sectional view of a main portion of a conventional container having a cap.
Figure 2:
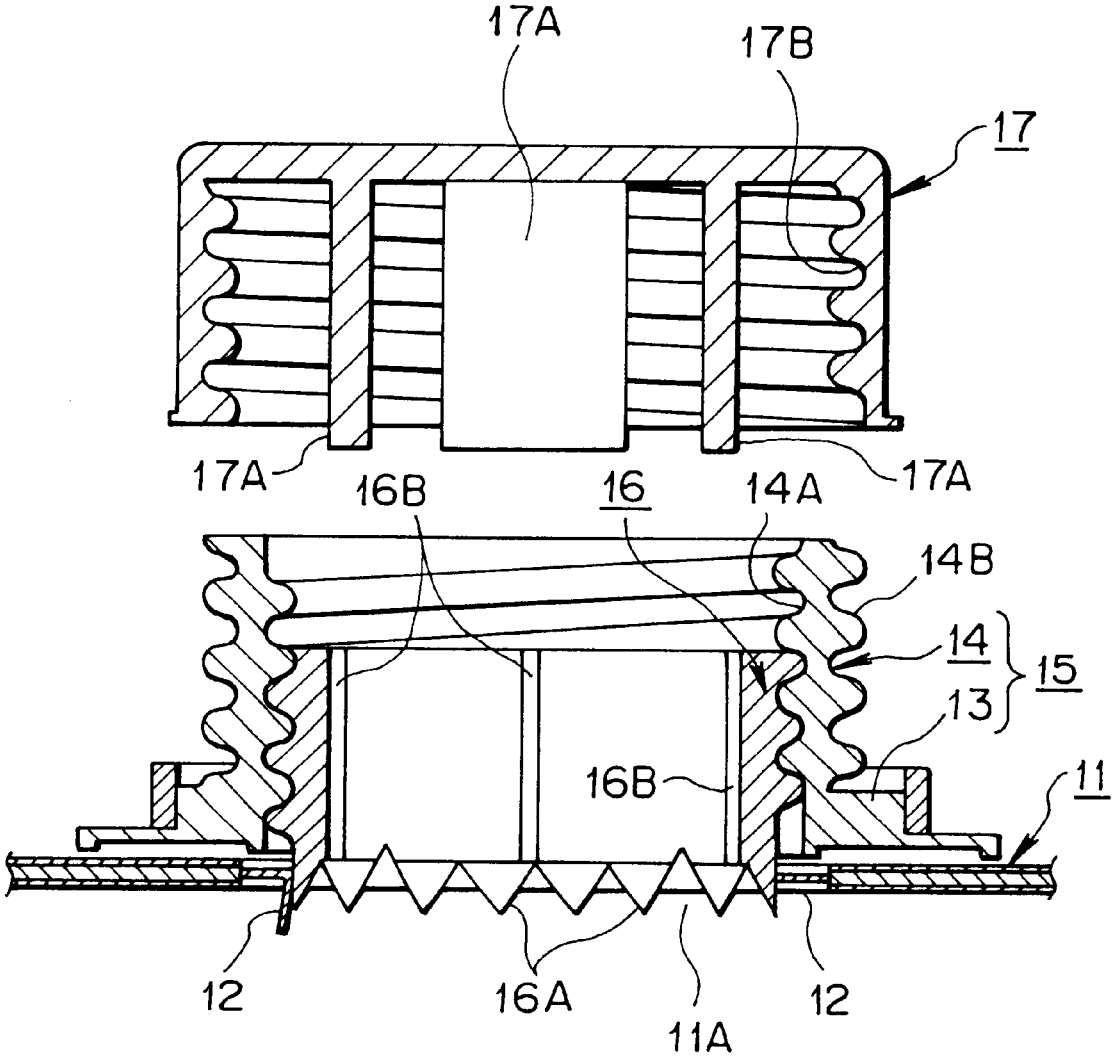
FIG. 2 PRIOR ART
FIG. 2 is a sectional view of a main portion of another conventional container having a cap.
Figure 3:
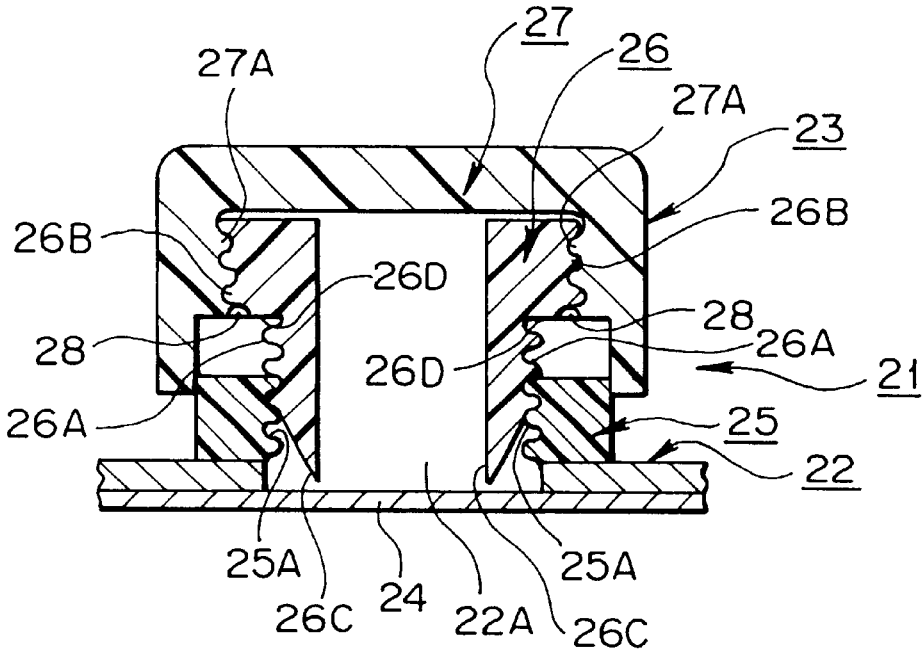
FIG. 3 is a sectional view of a main portion of a container having a cap according to a first embodiment of the present invention, illustrating a first state of the container.
Figure 4:
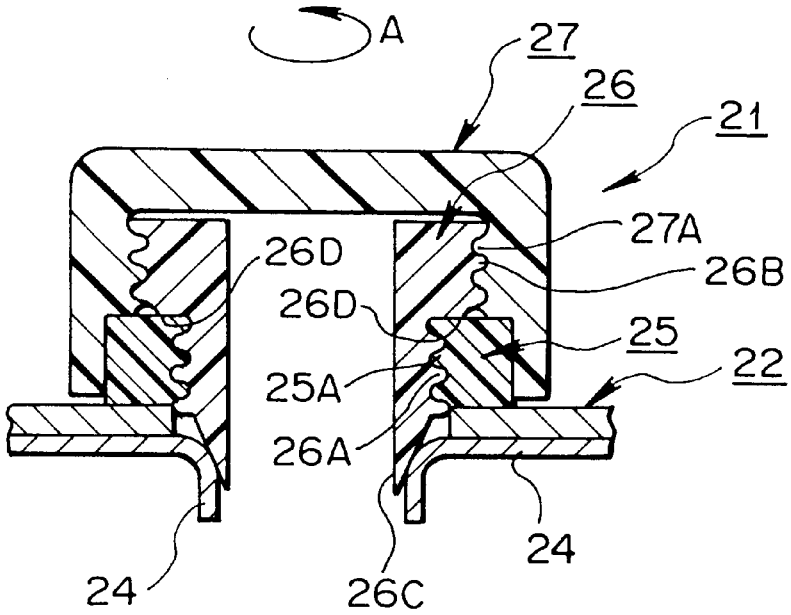
FIG. 4 is a sectional view of the main portion of the container having a cap according to the first embodiment, illustrating a second state of the container.
Figure 5:
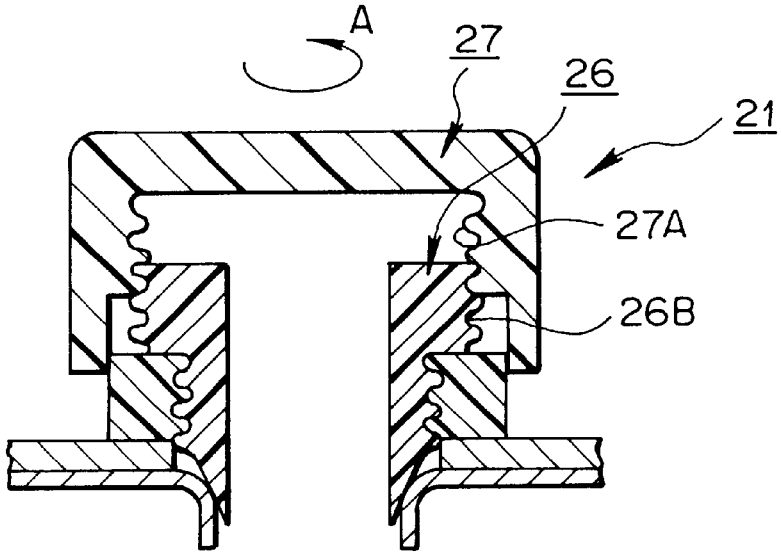
FIG. 5 is a sectional view of the main portion of the container having a cap according to the first embodiment, illustrating a third state of the container.
Figure 6:
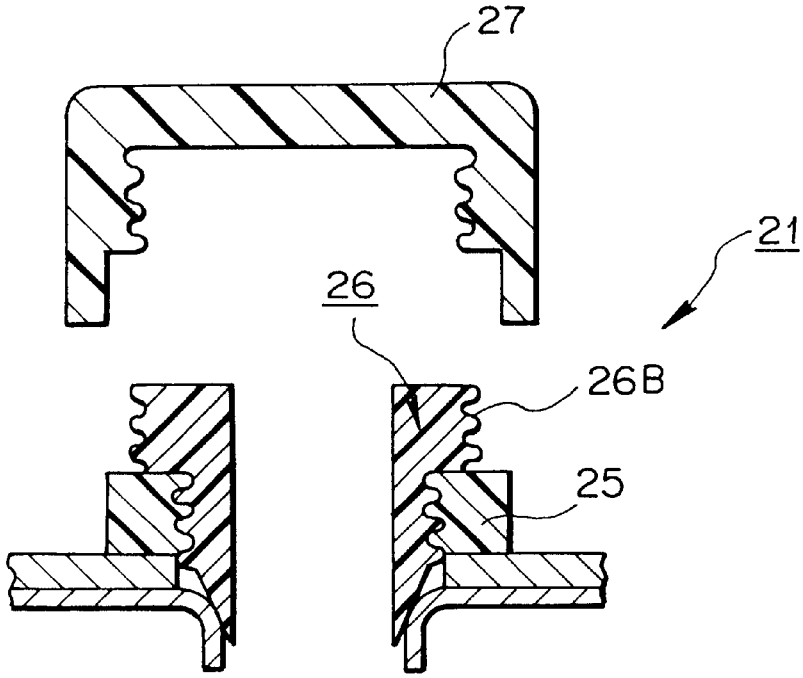
FIG. 6 is a sectional view of the main portion of the container having a cap according to the first embodiment, illustrating a fourth state of the container.
Figure 7:
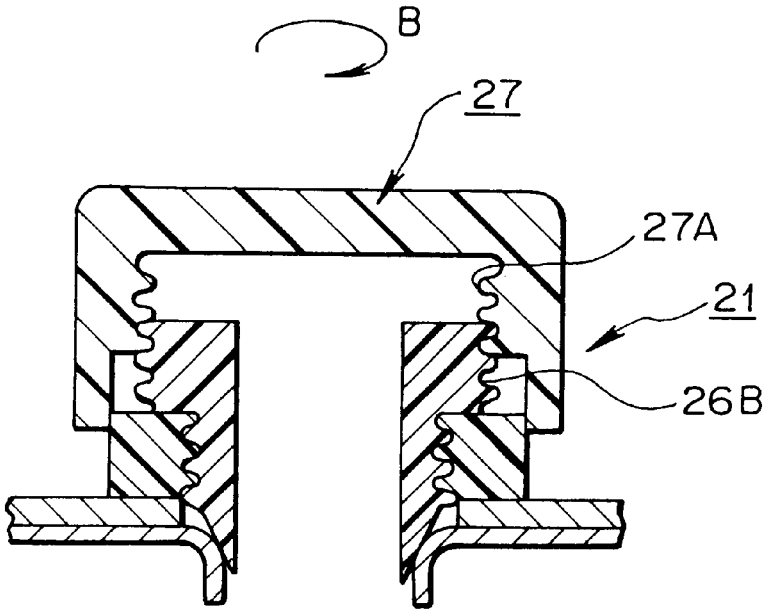
FIG. 7 is a sectional view of the main portion of the container having a cap according to the first embodiment, illustrating a fifth state of the container.
Figure 8:
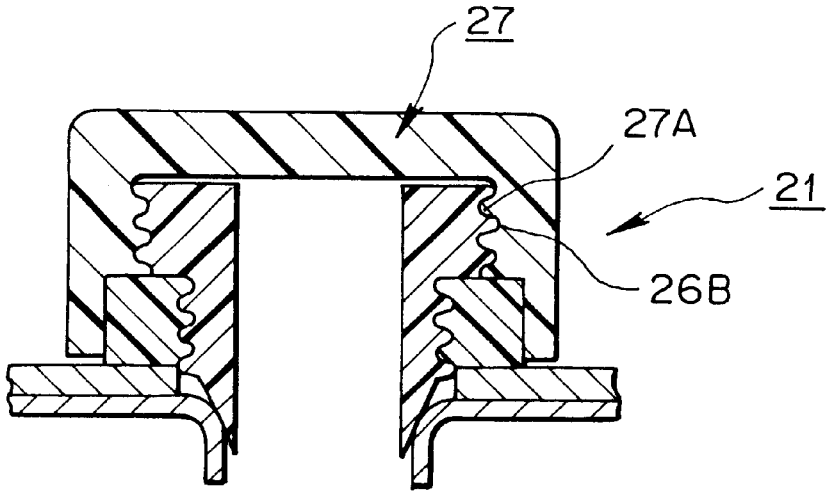
FIG. 8 is a sectional view of the main portion of the container having a cap according to the first embodiment, illustrating a sixth state of the container.

FIG. 3 is a sectional view of a main portion of a container having a cap according to a first embodiment of the present invention, illustrating a first state of the container; FIG. 4 is a sectional view of the main portion of the container having a cap according to the first embodiment, illustrating a second state of the container; FIG. 5 is a sectional view of the main portion of the container having a cap according to the first embodiment, illustrating a third state of the container; FIG. 6 is a sectional view of the main portion of the container having a cap according to the first embodiment, illustrating a fourth state of the container; FIG. 7 is a sectional view of the main portion of the container having a cap according to the first embodiment, illustrating a fifth state of the container; and FIG. 8 is a sectional view of the main portion of the container having a cap according to the first embodiment, illustrating a sixth state of the container.

In FIGS. 3 to 8, reference numeral 21 denotes a container for containing liquid food, which serves as the contents of the container. The container 21 includes a container body 22 and a cap 23. The container body 22 is formed of a packaging material, which includes a paper substrate treated in order to prevent leakage of liquid, and resin films covering both sides of the paper substrate. An opening portion 22A for discharging liquid food is formed on the top panel of the container body 22. The opening portion 22A is sealed by means of a sealing film 24, which is affixed to the container body 22 from inside (from underneath in FIG. 3), thereby forming a rupture portion. The cap 23 includes an annular base member 25, which is welded to the outer surface (the upper side in FIG. 3) of the container body 22 around the opening portion 22A; a substantially cylindrical retainer 26; and a screw cap 27. The cap 23 is attached to the container body 22 in correspondence with the rupture portion. The base member 25, the retainer 26, and the screw cap 27 are formed of resin. When the rupture portion is ruptured, a discharge opening is formed. The rupture portion may assume a form in which a sealing film is affixed to a paper substrate in such a manner as to cover a hole portion formed previously in the paper substrate, or a form in which a sealing film is affixed onto a paper substrate having perforations for defining a discharge opening.

A base female screw 25A, which is a left-hand screw, is formed on the inner surface of the base member 25. The retainer 26 includes a lower portion of a small diameter and an upper portion of a large diameter, between which a stepped portion 26D is provided as a boundary. A lower retainer male screw 26A, which is a left-hand screw, is formed on the outer surface of the lower portion of the retainer 26. An upper retainer male screw 26B, which is a right-hand screw, is formed on the outer surface of the upper portion of the retainer 26. A pointed tip portion 26C is formed at the tip (lower end in FIG. 3) of the retainer 26. The pointed tip portion 26C serves as the unsealing member for rupturing the sealing film 24 and assumes, for example, a saw-toothed shape. A screw cap female screw 27A, which is a right-hand screw, is formed on the inner surface of the screw cap 27. Notably, the right-hand screw advances when turned clockwise, and the left-hand screw advances when turned counterclockwise. In other words, the right-hand screw and the left-hand screw have opposite screw-engagement directions. The right-hand screw serves as a screw of a first screw-engagement direction, and the left-hand screw serves as a screw of a second screw-engagement direction.

A first screw-engagement portion is formed between the retainer 26 and the base member 25 by means of the lower retainer male screw 26A and the base female screw 25A. A second screw-engagement portion is formed between the retainer 26 and the screw cap 27 by means of the upper retainer male screw 26B and the screw cap female screw 27A.

Next, the function of the cap 23 will be described.

First, as shown in FIG. 3, when the container 21 is in a sealed state; i.e., in an initial state, the upper retainer male screw 26B and the screw cap female screw 27A are completely engaged. Also, the lower end of the upper retainer male screw 26B and the lower end of the screw cap female screw 27A are tentatively spot-welded, thus forming welded portions 28, which serve as the rotation control portion. The welded portions 28 inhibit relative rotation between the screw cap 27 and the retainer 26 when a force not greater than an allowable value is applied thereto, and permit relative rotation between the screw cap 27 and the retainer 26 when a force greater than the allowable value is applied thereto.

The lower retainer male screw 26A and the base female screw 25A are engaged to a relatively shallow depth. The pointed tip portion 26C is located above the sealing film 24 and thus is not in contact with the sealing film 24.

Next, as shown in FIG. 4, the screw cap 27 is turned counterclockwise; ie., in the direction of arrow A, for removal. In this case, the lower retainer male screw 26A and the base female screw 25A are left-hand screws; the upper retainer male screw 26B and the screw cap female screw 27A are right-hand screws; the direction of engagement between the lower retainer male screw 26A and the base female screw 25A is opposite to that between the upper retainer male screw 26B and the screw cap female screw 27A; and the lower end of the upper retainer male screw 26B and the lower end of the screw cap female screw 27A are tentatively spot-welded. Thus, when the screw cap 27 is rotated in the direction of arrow A, the screw cap 27 and the retainer 26 are rotated and advanced (moved downward in FIG. 4) as a unit, since relative rotation therebetween is inhibited. Accordingly, engagement between the lower retainer male screw 26A and the base female screw 25A becomes deep. In this case, the screw cap 27 is not removed.

As a result, the pointed tip portion 26C ruptures the sealing film 24, thereby opening the opening portion 22A. In the state shown in FIG. 4, when the screw cap 27 is rotated further in the direction of arrow A, a stepped portion 26D of the retainer 26 abuts the upper surface of the base member 25. Thus, further advancement of the retainer 26 and the screw cap 27 is prevented; i.e., rotation of the retainer 26 is prevented. That is, after the pointed tip portion 26C ruptures the rupture portion, the retainer 26 is moved axially by a predetermined amount and is then stopped. The stepped portion 26D and the upper surface of the base member 25 constitute stop means. In this case, there is no need for provision of a specific stopper for stopping the retainer 26, thereby not only simplifying the structure of the container 21, but also reducing the cost of the container 21.

Subsequently, as shown in FIG. 5, when the screw cap 27 is rotated further in the direction of arrow A, the welded portions 28 are broken, permitting relative rotation between the screw cap 27 and the retainer 26. The screw cap 27 is rotated about the upper retainer male screw 26B of the stopped retainer 26 in the direction of arrow A. As a result, engagement between the upper retainer male screw 26B and the screw cap female screw 27A becomes shallower. Then, as shown in FIG. 6, the screw cap 27 is removed from the retainer 26. In this state, a discharge opening is formed, allowing liquid food to be discharged from the container 21 therethrough.

In this case, by setting the length of the upper retainer male screw 26B and the height of the base member 25 to the respective predetermined values, there can be formed a discharge opening having a shape suited for drinking liquid food.

Next, as shown in FIG. 7, when the container 21 is to be closed, the screw cap 27 is rotated clockwise; i.e., in the direction of arrow B. Since the screw cap female screw 27A and the upper retainer male screw 26B are right-hand screws, the upper retainer male screw 26B and the screw cap female screw 27A can be completely engaged as shown in FIG. 8. Thus, the retainer 26 and the screw cap 27 can establish seal of high watertightness.

As described above, simply by rotating the screw cap 27 in the direction of arrow A for removal, the sealing film 24 is ruptured to unseal the container 21. Thus is simplified an unsealing operation. Also, simply by rotating the screw cap 27 in the direction of arrow B, the container 21 can be closed, thereby improving resealability and thus preventing leakage of liquid food. Since the structure of the retainer 26 and screw cap 27 can be simplified, the cost of the container 21 can be reduced.

In this case, since the retainer 26 is covered with the screw cap 27, the area of contact between the upper retainer male screw 26B and the screw cap female screw 27A can be increased. Thus, a torque transmitted from the screw cap 27 to the retainer 26 can be increased, so that the welded portions 28 are not easily broken.

Also, once the screw cap 27 is removed to unseal the container 21, engagement between the lower retainer male screw 26A and the base female screw 25A becomes deep, and the stepped portion 26D abuts the upper surface of the base member 25. Accordingly, even when the screw cap 27 is retightened, the container 21 cannot be restored to the initial state; therefore, the user can easily recognize that the container 21 has already been unsealed.

Next, a second embodiment of the present invention will be described. The same features as those of the first embodiment are denoted by common reference numerals, and their description is omitted.

Figure 9:
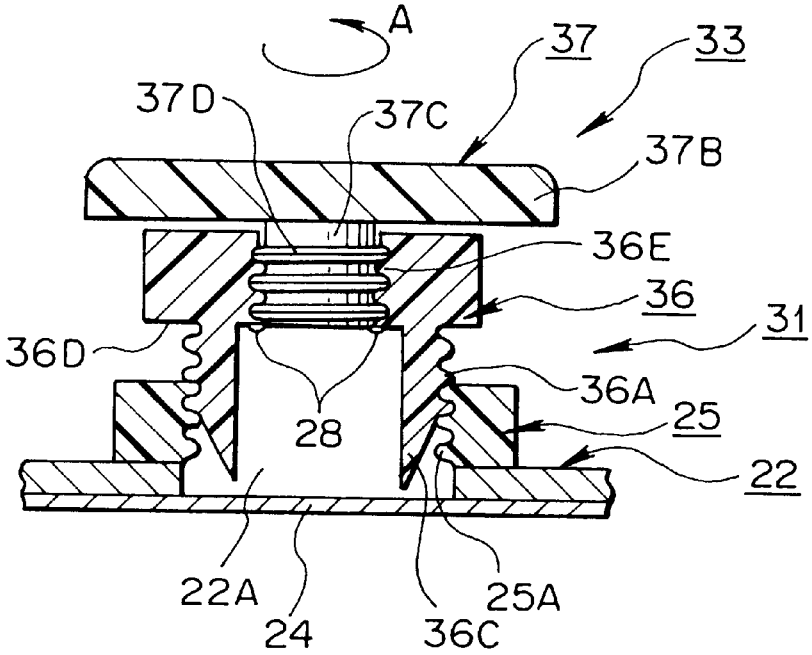
FIG. 9 is a sectional view of a main portion of a container having a cap according to a second embodiment of the present invention, illustrating a first state of the container.
Figure 10:
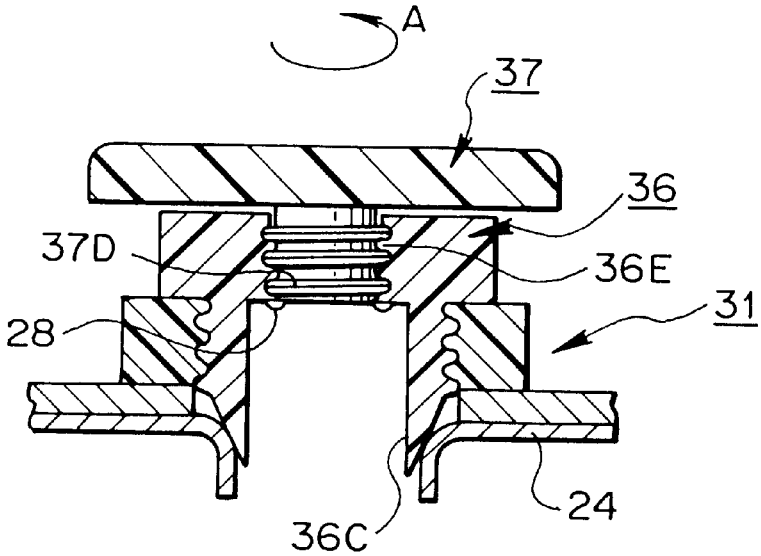
FIG. 10 is a sectional view of the main portion of the container having a cap according to the second embodiment, illustrating a second state of the container.

FIG. 9 is a sectional view of a main portion of a container having a cap according to a second embodiment of the present invention, illustrating a first state of the container; FIG. 10 is a sectional view of the main portion of the container having a cap according to the second embodiment, illustrating a second state of the container; and FIG. 11 is a sectional view of the main portion of the container having a cap according to the second embodiment, illustrating a third state of the container.

Figure 11:
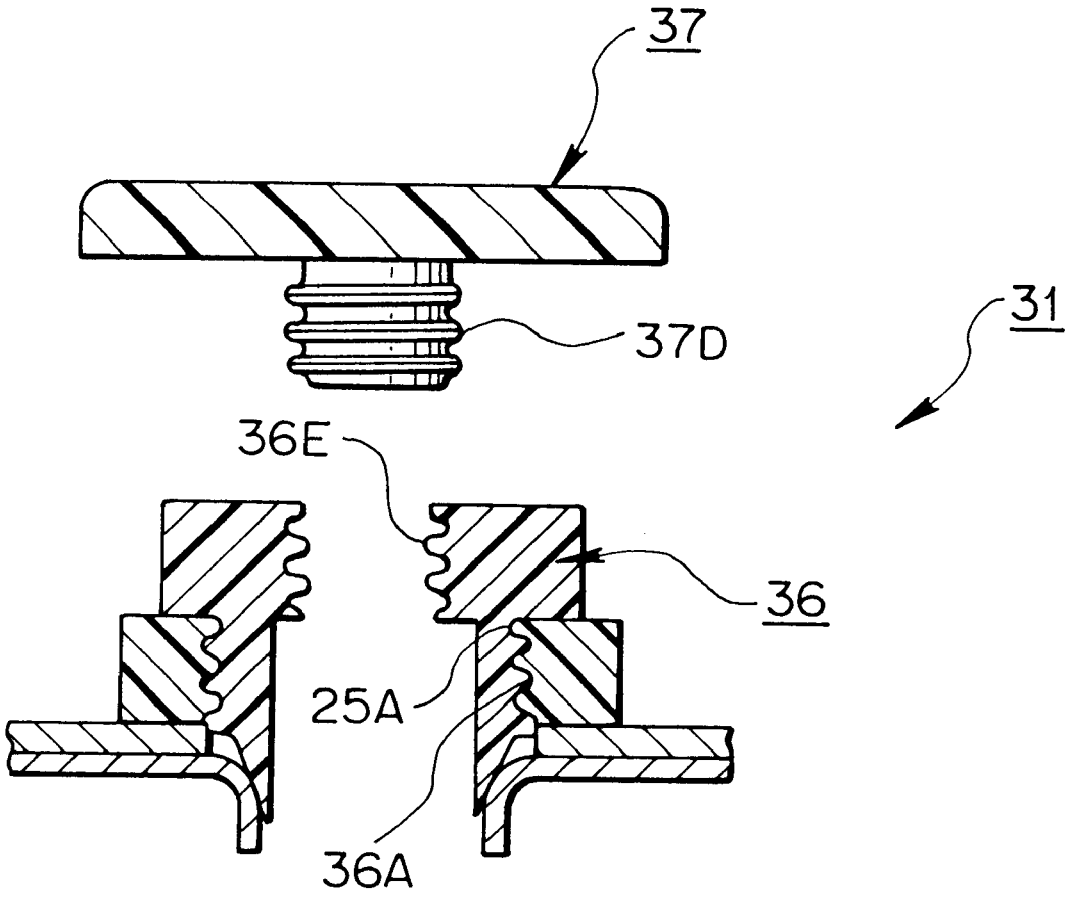
FIG. 11 is a sectional view of the main portion of the container having a cap according to the second embodiment, illustrating a third state of the container.

In FIGS. 9 to 11, reference numeral 31 denotes a container, and reference numeral 33 denotes a cap. The cap 33 includes a base member 25, a retainer 36, and a screw cap 37. The screw cap 37 has a vertical cross section having the shape of the letter "T" and includes a disk-shaped screw cap body 37B and a male screw plug portion 37C, which is integrally projected downward from the center of the lower surface of the screw cap body 37B. A screw cap male screw 37D, which is a right-hand screw, is formed on the circumferential surface of the male screw plug portion 37C. The retainer 36 has a substantially cylindrical shape and includes a lower portion having a small diameter and an upper portion having a large diameter, between which a stepped portion 36D is provided as a boundary. A lower retainer male screw 36A, which is a left-hand screw, is formed on the outer surface of the lower portion. An upper retainer female screw 36E, which is a right-hand screw, is formed on the inner surface of the upper portion. A pointed tip portion 36C is formed at the tip (lower end in FIG. 9) of the retainer 36 and is adapted to rupture the sealing film 24. Notably, no screw is formed on the outer surface of the upper portion of the retainer 36. A first screw-engagement portion is formed between the retainer 36 and the base member 25 by means of the lower retainer male screw 36A and the base female screw 25A. A second screw-engagement portion is formed between the retainer 36 and the screw cap 37 by means of the screw cap male screw 37D and the upper retainer female screw 36E.

Next, the function of the cap 33 will be described.

First, as shown in FIG. 9, when the container 31 is in a sealed state; i.e., in an initial state, the upper retainer female screw 36E and the screw cap male screw 37D are completely engaged. Also, the lower end of the upper retainer female screw 36E and the lower end of the screw cap male screw 37D are spot-welded, thus forming welded portions 28, which serve as the rotation control portion.

The lower retainer male screw 36A and the base female screw 25A are engaged to a relatively shallow depth. The pointed tip portion 36C is located above the sealing film 24 and thus is not in contact with the sealing film 24.

Next, in the above-described initial state, the screw cap 37 is turned counterclockwise; i.e., in the direction of arrow A, for removal. In this case, the lower retainer male screw 36A and the base female screw 25A are left-hand screws; the upper retainer female screw 36E and the screw cap male screw 37D are right-hand screws; the direction of engagement between the lower retainer male screw 36A and the base female screw 25A is opposite to that between the upper retainer female screw 36E and the screw cap male screw 37D; and the lower end of the upper retainer female screw 36E and the lower end of the screw cap male screw 37D are spot-welded. Thus, when the screw cap 37 is rotated in the direction of arrow A, the screw cap 37 and the retainer 36 are rotated and advanced (moved downward in FIG. 9) as a unit. Accordingly, engagement between the lower retainer male screw 36A and the base female screw 25A becomes deep. Subsequently, when the stepped portion 36D abuts the upper surface of the base member 25, further advancement of the retainer 36 and the screw cap 37 is prevented; i.e., rotation of the retainer 36 is prevented. In this case, the screw cap 37 remains unremoved.

As a result, as shown in FIG. 10, the pointed tip portion 36C ruptures the sealing film 24, thereby opening the opening portion 22A. In the state shown in FIG. 10, when the screw cap 37 is rotated further in the direction of arrow A, the welded portions 28 are broken, so that the screw cap 37 is rotated relative to the upper retainer female screw 36E of the stopped retainer 36 in the direction of arrow A. As a result, engagement between the upper retainer female screw 36E and the screw cap male screw 37D becomes shallower. Then, as shown in FIG. 11, the screw cap 37 is removed from the retainer 36. In this state, a discharge opening is formed, allowing liquid food to be discharged from the container 31 therethrough.

Next, when the container 31 is to be closed, the screw cap 37 is rotated clockwise, i.e., in the direction of arrow B (FIG. 7). Since the upper retainer female screw 36E and the screw cap male screw 37D and are right-hand screws, the upper retainer female screw 36E and the screw cap male screw 37D can be completely engaged. Thus, the retainer 36 and the screw cap 37 can establish seal of high watertightness.

As described above, simply by rotating the screw cap 37 in the direction of arrow A for removal, the sealing film 24 is ruptured to unseal the container 31. Thus is simplified an unsealing operation. Also, simply by rotating the screw cap 37 in the direction of arrow B, the container 31 can be closed, thereby improving resealability and thus preventing leakage of liquid food. Since the structure of the retainer 36 and screw cap 37 can be simplified, the cost of the container 31 can be reduced.

Also, once the screw cap 37 is removed to unseal the container 31, engagement between the lower retainer male screw 36A and the base female screw 25A becomes deep, and the stepped portion 36D abuts the upper surface of the base member 25. Accordingly, even when the screw cap 37 is retightened, the container 31 cannot be restored to the initial state; therefore, the user can easily recognize that the container 31 has already been unsealed.

In the above-described embodiments, for example, an elastic sealing material of resin may be affixed to the upper surface of the base member 25, to thereby impart high watertightness to the surface of contact between the screw cap 27 (37) and the base member 25.

In the second embodiment, the outer diameter of the upper portion of the retainer 36 may be rendered equal to that of the base member 25, so that a good feeling of contact can be given to a user when the user places his/her lips on the retainer 36 to drink the liquid food.

The present invention is not limited to the above-described embodiments. Numerous modifications and variations of the present invention are possible in light of the spirit of the present invention, and they are not excluded from the scope of the present invention.

Industrial Applicability

The present invention is applicable to a container having a cap adapted to contain liquid food.

What is claimed is:

1. A container having a cap comprising:

(a) a container body having a rupture portion for forming a discharge opening, and (b) a cap attached to said container body in correspondence to said rupture portion, wherein (c) said cap comprises an annular base member fixedly attached to said container body, a screw cap, and a retainer comprising an unsealing member formed at a tip for rupturing said rupture portion, a first screw-engagement portion defined in cooperation with said base member, and a second screw-engagement portion defined in cooperation with said screw cap;

(d) said first and second screw-engagement portions have screw-engagement directions opposite to each other;

(e) said screw cap and said retainer include a rotation control portion, which inhibits relative rotation therebetween when a force not greater than an allowable value is applied thereto and which permits relative rotation therebetween when a force greater than the allowable value is applied thereto; and (f) after said rupture portion is ruptured, said retainer is moved axially by a predetermined amount and is then stopped by stop means.

2. A container having a cap as described in claim 1, wherein said first screw-engagement portion comprises a lower retainer male screw formed on an outer surface of a lower portion of said retainer, and a base female screw formed on an inner surface of said base member.

3. A container having a cap as described in claim 1, wherein said second screw-engagement portion comprises an upper retainer male screw formed on an outer surface of an upper portion of said retainer, and a screw cap female screw formed on an inner surface of said screw cap.

4. A container having a cap as described in claim 1, wherein said second screw-engagement portion comprises a screw cap male screw formed on an outer surface of said screw cap and an upper retainer female screw formed on an inner surface of an upper portion of said retainer.

5. A container having a cap as described in claim 1, wherein said screw cap is advanced while being rotated in a removing direction.

6. A container having a cap as described in claim 1, wherein, while said rotation control portion inhibits relative rotation, rotation of said screw cap causes rotation and advancement of said retainer, causing said unsealing member to rupture said rupture portion.

7. A container having a cap as described in claim 1, wherein said rotation control portion assumes the form of a welded portion formed by welding said screw cap and said retainer.

8. A container having a cap as described in claim 1, wherein said stop means comprises a stepped portion formed on said retainer and an upper surface of said base member.

* * * * *